US010304644B2

(12) United States Patent
Hwang et al.

(10) Patent No.: US 10,304,644 B2
(45) Date of Patent: May 28, 2019

(54) VACUUM INTERRUPTER AND DRIVING METHOD THEREFOR

(71) Applicant: HYOSUNG HEAVY INDUSTRIES CORPORATION, Seoul (KR)

(72) Inventors: Hui-Dong Hwang, Changwon-si (KR); Young-Hwan Chung, Changwon-si (KR); Nam-Kyung Kim, Changwon-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 22 days.

(21) Appl. No.: 15/540,924

(22) PCT Filed: Dec. 29, 2015

(86) PCT No.: PCT/KR2015/014447

§ 371 (c)(1),
(2) Date: Jun. 29, 2017

(87) PCT Pub. No.: WO2016/108598

PCT Pub. Date: Jul. 7, 2016

(65) Prior Publication Data

US 2018/0294115 A1 Oct. 11, 2018

(30) Foreign Application Priority Data

Dec. 31, 2014 (KR) ..... 10-2014-0195567

(51) Int. Cl.
*H01H 33/666* (2006.01)
*H01H 1/50* (2006.01)
(Continued)

(52) U.S. Cl.
CPC ..... *H01H 33/666* (2013.01); *H01H 1/50* (2013.01); *H01H 3/0253* (2013.01);
(Continued)

(58) Field of Classification Search
CPC . H01H 33/666; H01H 33/662; H01H 33/6641
See application file for complete search history.

(56) References Cited

U.S. PATENT DOCUMENTS 3,914,568 A * 10/1975 Crouch ..... H01H 33/66261 218/123
4,081,640 A 3/1978 Rich
(Continued)

FOREIGN PATENT DOCUMENTS

JP 2000-215768 A 8/2000
JP 2002-124157 A 4/2002
(Continued)

*Primary Examiner* — Truc T Nguyen
(74) *Attorney, Agent, or Firm* — Novick , Kim & Lee, PLLC; Jae Youn Kim

(57) ABSTRACT

The present invention relates to a vacuum interrupter for a circuit breaker capable of forming and releasing a short circuit by moving two movable electrodes in forward/backward directions, and a driving method therefor. The vacuum interrupter according to the present invention includes: a housing with a vacuum state therein; and first and second movable electrodes partially accommodated within the housing, and attached to first and second movable contacts at respective ends thereof, wherein the first and second movable electrodes are capable of moving in forward/backward directions, and the first and second movable contacts contact each other and separate from each other by the movement in forward/backward directions of the first and second electrodes.

12 Claims, 4 Drawing Sheets

(51) Int. Cl.

| | |
|---|---|
| ***H01H 3/02*** | (2006.01) |
| ***H01H 33/662*** | (2006.01) |
| ***H01H 33/664*** | (2006.01) |
| *H01H 33/28* | (2006.01) |

(52) U.S. Cl.
CPC ..... *H01H 33/662* (2013.01); *H01H 33/6641* (2013.01); *H01H 33/285* (2013.01)

(56) References Cited

U.S. PATENT DOCUMENTS 4,115,672 A * 9/1978 Lipperts ..... H01F 5/00 218/142
4,250,363 A 2/1981 Heberlein et al.
4,281,231 A * 7/1981 Griesen ..... H01H 33/664 218/123
2001/0030173 A1* 10/2001 Ulanovsky ..... H01H 1/06 218/22
2005/0067380 A1* 3/2005 Rhein ..... H01H 33/6662 218/118
2012/0175347 A1* 7/2012 Glaser ..... H01H 33/166 218/140
2013/0057083 A1 3/2013 Donzel et al.
2014/0251958 A1* 9/2014 Wang ..... H01H 33/662 218/137
2014/0291293 A1* 10/2014 Gentsch ..... H01H 33/66207 218/139

FOREIGN PATENT DOCUMENTS

| | | | |
|---|---|---|---|
| JP | 2003-016886 | A | 1/2003 |
| JP | 2014-067512 | A | 4/2014 |
| KR | 10-2000-0008930 | A | 2/2000 |
| KR | 10-2009-0113687 | A | 11/2009 |
| WO | 2014000790 | A1 | 1/2014 |

* cited by examiner

VACUUM INTERRUPTER AND DRIVING METHOD THEREFOR

TECHNICAL FIELD

The present invention relates to a vacuum interrupter for a circuit breaker. More particularly, the present invention relates to a vacuum interrupter for a circuit breaker capable of forming and releasing a short circuit by moving two movable electrodes in forward/backward directions, and a driving method therefor.

BACKGROUND ART

Generally, vacuum circuit breakers are circuit and appliance protecting apparatuses in which an arc generated when switching a normal load or blocking a fault current is extinguished in a vacuum interrupter in order to rapidly separate a circuit. Such a vacuum interrupter is made of an electrically insulating material such as ceramic as a key component of a vacuum circuit breaker. In addition, a movable contact and a fixed contact are provided inside an insulated housing with a vacuum state therein, so that an arc generated when switching is performed is rapidly extinguished. Thus, vacuum circuit breakers are used as contacting devices for switching a power system.

FIG. 1 is a configuration diagram of a general conventional vacuum interrupter. A conventional vacuum interrupter 10 includes a fixed electrode 12 and a movable electrode 14, and a housing 11 that is vacuum sealed so that inside thereof is maintained in a vacuum state, the fixed electrode 12 and the movable electrode 14 being provided in the housing 11. The fixed electrode 12 is fixed on a fixed member 18. The fixed electrode 12 and the movable electrode 14 are attached with a fixed contact 13 and a movable contact 15, respectively. The fixed electrode 12, the fixed contact 13, the movable electrode 14, and the movable contact 15 are installed on the same straight line. In addition, a known bellows 16 is installed inside the housing 11 on the side of the movable electrode 14.

In addition, a movement unit 17 is installed outside of the housing 11 so that the movable electrode 14 straightly moves. The movement unit 17 straightly moves the movable electrode 14 so that the movable contact contacts with and separates from the fixed contact 13 of the fixed electrode 12, thus an electric short circuit is formed and released within the vacuum interrupter 10.

However, in the conventional vacuum interrupter 10, speed in forming and releasing a short circuit is limited since the movable electrode 14 only straightly moves to contact with and separate from the fixed electrode 12 that is fixed in one side. Particularly, in a high voltage direct current transmission (HVDC) system, such speed is important since forming and releasing a short circuit in a vacuum interrupter has to be performed at a high speed. However, in a conventional method, there is a limit to increasing speed since the movable electrode 14 only moves to form and release the short circuit.

In addition, since the movable electrode 14 straightly moves and contacts the fixed contact 13 to form a short circuit in the vacuum interrupter 10, mechanical impact occurs at the fixed contact 13. Such an impact may cause misalignment between the fixed contact 13 and the movable contact 15, or may become a cause of various deformations, or cracks. In addition, the impact may also adversely affect vacuum tightness of inside the housing 11.

In order to solve the above problems, a configuration that absorbs the mechanical impact within the conventional vacuum interrupter is provided. The impact applied to the fixed electrode 12 is absorbed by installing an impact absorbing means outside the housing 11 on the side of the fixed electrode 12.

However, in such a conventional method, since the movable contact 15 moves fast and contacts the fixed contact 13, it cannot fundamentally solve the problem caused by the mechanical impact applied to the fixed electrode 12 and the fixed contact 13.

DISCLOSURE

Technical Problem

Accordingly, the present invention has been made keeping in mind the above problems occurring in the prior art, and an object of the present invention is to provide a vacuum interrupter, wherein the vacuum interrupter is driven at both sides by driving two movable electrodes in both sides so that speed in forming and releasing a short circuit is increased.

In addition, another object of the present invention is to provide a vacuum interrupter, wherein the vacuum interrupter is driven at both sides and is capable of efficiently absorbing impact occurring at both movable electrodes when contacting each other by straightly moving the movable electrodes.

Technical Solution

A vacuum interrupter according to the present invention includes: a housing with a vacuum state therein; and first and second movable electrodes partially accommodated within the housing, and provided with first and second movable contacts at respective end parts thereof, wherein the first and second movable electrodes are capable of moving in forward/backward directions, and the first and second movable contacts contact each other and separate from each other by movements in forward/backward directions of the first and second electrodes.

In the present invention, when the first and second movable electrodes move such that the first and second movable contacts contact each other, the first and second movable electrodes may simultaneously move, or move with a predetermined time interval.

In the present invention, when the first and second movable electrodes move close to each other, a moving speed of at least one of the first and second movable electrodes gradually may decreases to a predetermined level before the first and second movable contacts contact each other.

In addition, a vacuum interrupter according to the present invention includes: a housing with a vacuum state therein; first and second movable electrodes partially accommodated within the housing and provided with to first and second movable contacts at respectively first ends thereof, the first and second movable electrodes being capable of moving in forward/backward directions so that the first and second movable contacts contact each other and separate from each other by movements in forward/backward directions of the first and second electrodes; first and second driving units respectively connected to second ends of the first and second movable electrodes and moving the first and second movable electrodes in forward/backward directions; and a controller controlling movements of the first and second driving units.

In the present invention, the controller may control the first and second driving units to move the first and second movable electrodes so that the first and second movable contacts contact each other, the first and second movable electrodes simultaneously moving, or moving with a predetermined time interval.

In the present invention, each of the first and second driving units may include: a contact coil generating magnetic force by using current applied from the controller and moving an associated movable electrode so that the first and second movable contacts contact each other; and a separation coil generating magnetic force by using current applied from the controller and moving an associated movable electrode so that the first and second movable contacts separate from each other.

In the present invention, the controller may apply current to the contact coils such that the first and second movable contacts contact each other, and apply current to the separation coils just before the first and second movable contacts contact each other such that moving speeds of the first and second movable contacts gradually decrease.

In the present invention, the controller may simultaneously apply current to the contact coils of the first and second driving units, and simultaneously apply current to the separation coils of the first and second driving units when a predetermined time has passed after applying current to the contact coils of the first and second driving units.

In the present invention, the controller may simultaneously apply current to the contact coils of the first and second driving units, and apply current to any one of the separation coils of the first and second driving units when a predetermined time has passed after applying current to the contact coils of the first and second driving units.

In addition, a vacuum interrupter driving method according to an embodiment of the present invention includes: respectively moving first and second movable electrodes within a vacuum interrupter; and contacting first and second movable contacts each other according to movements of the first and second movable electrodes, the first and second movable contacts being respectively attached to first ends of the first and second movable electrodes.

In the present invention, the first and second movable electrodes may simultaneously move, or move with a predetermined time interval.

In the present invention, in the moving of the first and second movable electrodes, a moving speed of at least one of the first and second movable electrodes may gradually decrease to a predetermined level just before the first and second movable contacts contact each other.

In the present invention, the method may further include: after contacting the first and second movable contacts each other, moving the first and second movable electrodes far away from each other so that the first and second movable contacts separate from each other.

In addition, a vacuum interrupter driving method according to another embodiment of the present invention includes: respectively applying current to contact coils of first and second driving units to respectively move first and second movable electrodes within a vacuum interrupter; respectively moving the first and second movable electrodes by using magnetic force of the contact coils generated by the applied current so that first and second movable contacts respectively attached to first ends of the first and second movable electrodes contact each other; and respectively applying current to separation coils of the first and second driving units just before the first and second movable contacts contact each other so that moving speeds of the first and second movable electrodes gradually decreases.

In the present invention, the method may further include: after contacting the first and second movable contacts each other, respectively applying current to the separation coils of first and second driving units so that first and second movable contacts separate from each other; and moving the first and second movable electrodes far away from each other by using magnetic force of the separation coils generated by the applied current so that the first and second movable contacts move far away from each other.

Advantageous Effects

As described above, according to the present invention, speed in forming and releasing a short circuit may be increased by forming two electrodes of a vacuum interrupter as movable electrodes, and by straightly moving the two movable electrodes in forward/backward directions.

In addition, according to the present invention, a service life of a vacuum interrupter may be increased since mechanical impact generated when the two movable electrodes contact each other is effectively reduced.

In addition, according to the present invention, when a vacuum interrupter is applied to an HVDC system, the reliability of the system may be increased since a short circuit is rapidly released.

MODE FOR INVENTION

Figure 1:
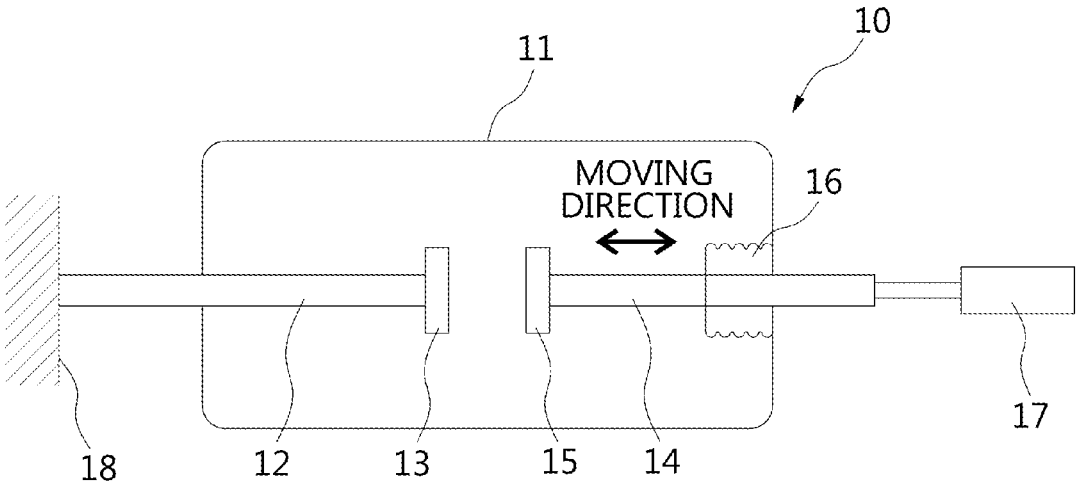
FIG. 1 PRIOR ART
FIG. 1 is a configuration diagram of a general conventional vacuum interrupter.

Hereinafter, exemplary embodiments of the present invention will be described with reference to the accompanying drawings. In the following description, the same elements will be designated by the same reference numerals although they are shown in different drawings. Further, in the following description of the present invention, a detailed description of known functions and configurations incorporated herein will be omitted when it may make the subject matter of the present invention unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected", "coupled", or "joined" to another component, a third component may be "connected", "coupled", and "joined" between the first and second components, although the first component may be directly connected, coupled, or joined to the second component.

Figure 2:
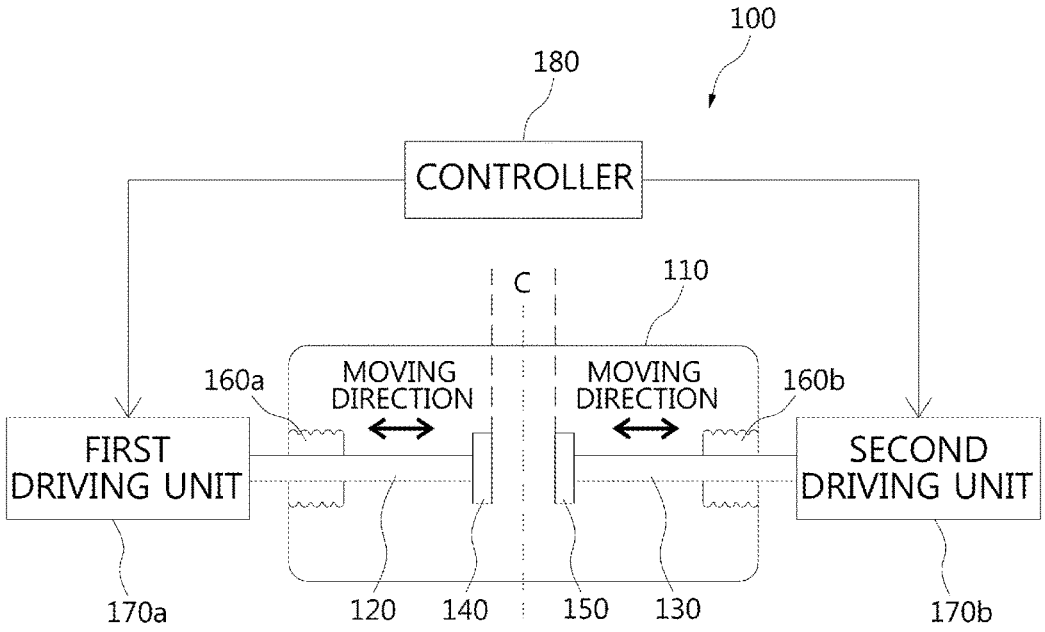
FIG. 2 is an operation diagram of a vacuum interrupter according to an embodiment of the present invention.

FIG. 2 is an operation diagram of a vacuum interrupter according to an embodiment of the present invention.

Referring to FIG. 2, a vacuum interrupter 100 according to the present invention includes: a housing 110 with a vacuum state therein; and first and second movable electrodes 120 and 130 which are partially accommodated within the housing 110. The first and second movable electrodes 120 and 130 are respectively capable of moving in forward/backward directions. In other words, the first and second movable electrodes 120 and 130 are capable of moving backward and forward, and namely in inward and outward directions. Bellows 160*a* and 160*b* are respectively provided in first end parts of the first and second movable electrodes 120 and 130 and both sides of inside the housing 110 so that the first and second movable electrodes 120 and 130 easily move and vacuum air tightness of the housing 110 is maintained.

In addition, the first and second movable electrodes 120 and 130 are provided with a first movable contact 140 and a second movable contact 150 at first ends thereof, respectively. Since the first and second movable contacts 140 and 150 are respectively attached at the first ends of the first and second movable electrodes 120 and 130 as described above, the first and second movable contacts 140 and 150 contact with or separate from each other according to respective forward/backward movements of the first and second movable electrodes 120 and 130. The above processes are performed to form an electric short circuit and to release the electric short circuit within the vacuum interrupter 100.

In addition, the vacuum interrupter 100 of the present invention includes: first and second driving units 170*a* and 170*b* respectively connected to second ends of the first and second movable electrodes 120 and 130 and moving the first and second movable electrodes 120 and 130 in forward/backward directions; and a controller 180 controlling operations of the first and second driving units 170*a* and 170*b*. In detail, the first driving unit 170*a* is connected to the second end of the first driving unit 170*a* and moves the first movable electrode 120 in forward/backward directions by using current applied from the controller 180. The second driving unit 170*b* is connected to the second end of the second movable electrode 130 and moves the second movable electrode 130 in forward/backward directions by using current applied from the controller 180. Accordingly, according to a need for forming and releasing a short circuit in the vacuum interrupter 100, the controller 180 applies current to the first and second driving units 170*a* and 170*b* so that the first and second movable contacts 140 and 150 provided at one ends of the first and second movable electrodes 120 and 130 contact with and separate from each other. Herein, when necessary, the controller 180 may adjust moving times and moving speeds of the first and second movable electrodes 120 and 130. In other words, the controller 180 may control operation times of the first and second driving units 170*a* and 170*b* by adjusting times of applying current to the first driving unit 170*a* and the second driving unit 170*b*. When the vacuum interrupter 100 is applied to an HVDC system, the reliability of blocking the system may be improved when a failure occurs since the system is rapidly blocked. In the present invention, the first and second movable electrodes 120 and 130 may move in forward/backward directions at the same time or with a predetermined time interval by using the above processes. In addition, the first and second driving units 170*a* and 170*b* may adjust moving speeds of the first and second movable electrodes 120 and 130. This will be described in detail below.

Figure 3:
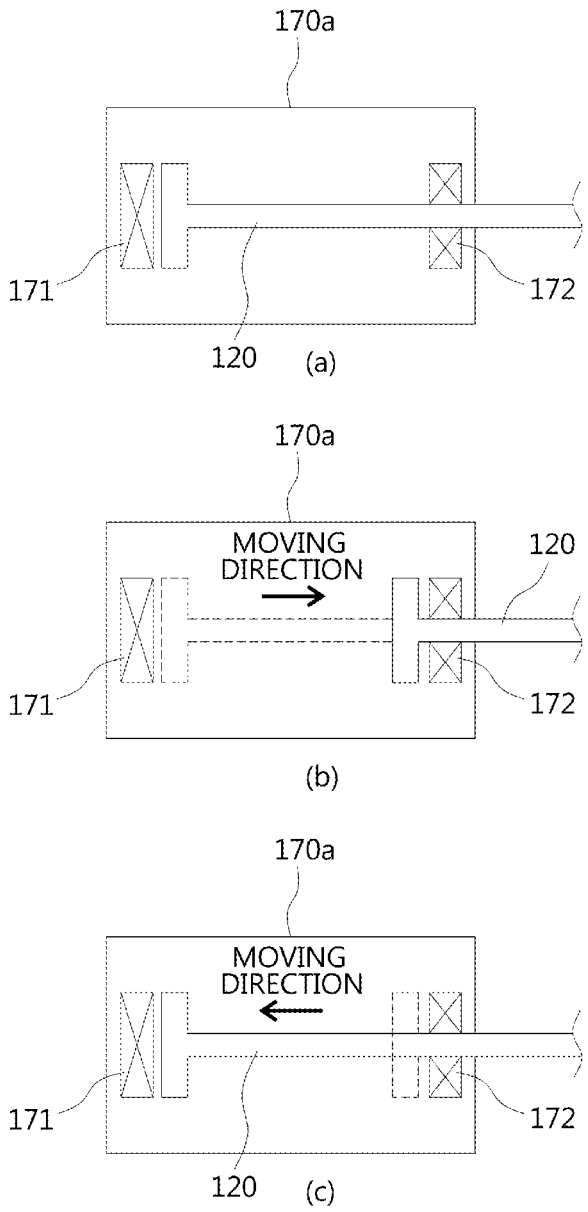
FIG. 3 is a configuration view showing the operation diagram of the vacuum interrupter according to the embodiment of the present invention.

FIG. 3 is a configuration view showing the operation diagram of the vacuum interrupter according to the embodiment of the present invention.

Referring to FIG. 3, each of the first and second driving units 170*a* and 170*b* of the vacuum interrupter 100 according to the embodiment of the present invention includes a contact coil 171 and a separation coil 172. Since the first and second driving units 170*a* and 170*b* are different in that moving directions of the movable electrodes are different from each other, and configurations and operations thereof are the same, the first driving unit 170*a* will be described with reference to FIG. 3.

The contact coil 171 is connected to a rear end of the first movable electrode 120, generates magnetic force when current is applied from the controller 180, and moves the first movable electrode 120 by pushing the first movable electrode 120 toward inside the housing 110 using the generated magnetic force. In addition, the separation coil 172 is provided in a front end of the first movable electrode 120, generates magnetic force when current is applied from the controller 180, and moves the first movable electrode 120 by pushing the first movable electrode 120 toward outside the housing 110 using the generated magnetic force.

Accordingly, when current is applied to the contact coil 171 and the first movable electrode 120 moves toward the inside the housing 110, the first movable electrode 120 approaches to the separation coil 172 at an end part thereof. In addition, when current is applied to separation coil 172 and the first movable electrode 120 is moved toward outside the housing 110, the first movable electrode 120 approaches to the contact coil 171 at the end part thereof. Accordingly, when the first movable electrode 120 approaches to the contact coil 171 at the end part thereof, the first and second movable contacts 140 and 150 separate from each other, and when the first movable electrode 120 approaches to the separation coil 172 at the end part thereof, the first and second movable contacts 140 and 150 contact each other.

As described above, the respective contact coils 171 of the first and second driving units 170*a* and 170*b* move the first and second movable electrodes 120 and 130 such that the first and second movable contacts 140 and 150 contact each other. In addition, the respective separation coils 172 of the first and second driving units 170*a* and 170*b* move the first and second movable electrodes 120 and 130 such that the first and second movable contacts 140 and 150 separate from each other.

FIG. 3(*a*) shows a state in which the first movable electrode 120 approaches to the contact coil 171. As described above, the state means that the first and second movable contacts 140 and 150 are separated from each other. When the controller 180 applies current to the contact coil 171 in order to contact the first and second movable contacts 140 and 150 with each other, as shown in FIG. 3(*b*), the first movable electrode 120 moves and approaches to the separation coil 172. Then, when the controller 180 applies current to the separation coil 172 in order to separate the first and second movable contacts 140 and 150 from each other, as shown in FIG. 3(*c*), the first movable electrode 120 moves again and approaches to the contact coil 171. This is the same as FIG. 3(*a*). As described above, the first and second movable contacts 140 and 150 contact each other and separate from each other by moving the first and second movable electrodes 120 and 130 by applying current to the contact coils 171 and the separation coils 172.

Herein, the first and second driving units 170*a* and 170*b* move the first and second movable electrodes 120 and 130 at the same time, or with a predetermined time interval. When the first and second movable electrodes 120 and 130 move with a fixed time interval while forming a short circuit, since one of the first and second movable electrodes 120 and 130 reaches the center point C first and then the other movable electrode contacts therewith, impact is relatively smaller than when the two electrodes arrive at the same time. Of course, it is preferable from a viewpoint of speed to move the electrodes at the same time when a means for absorbing the impact is provided.

In addition, the controller 180 may control times of applying current to the contact coils 171 and the separation coils 172, and control moving speeds of the first and second movable electrodes 120 and 130. This will be described in detail with reference to the example of FIG. 3. First, as shown in FIG. 3(*a*), the controller 180 applies current to the contact coil 171, and moves the first movable electrode 120 toward inside the housing 110 as shown in FIG. 3(*b*). Herein, the controller 180 may apply current to the separation coil 172 just before the first and second movable contacts 140 and 150 contact each other, thus a moving speed of the first movable electrode 120 may gradually decreases. In other words, the controller 180 applies current to the contact coil 171 so that the first and second movable contacts 140 and 150 contact each other, and applies current to separation coil 172 just before the first and second movable contacts 140 and 150 contact each other so that magnetic force is generated opposite to a moving direction and the moving speed of the first movable electrode 120 gradually decreases. The above process is performed to reduce mechanical impact generated when first and second movable contacts 140 and 150 contact each other.

Figure 4:
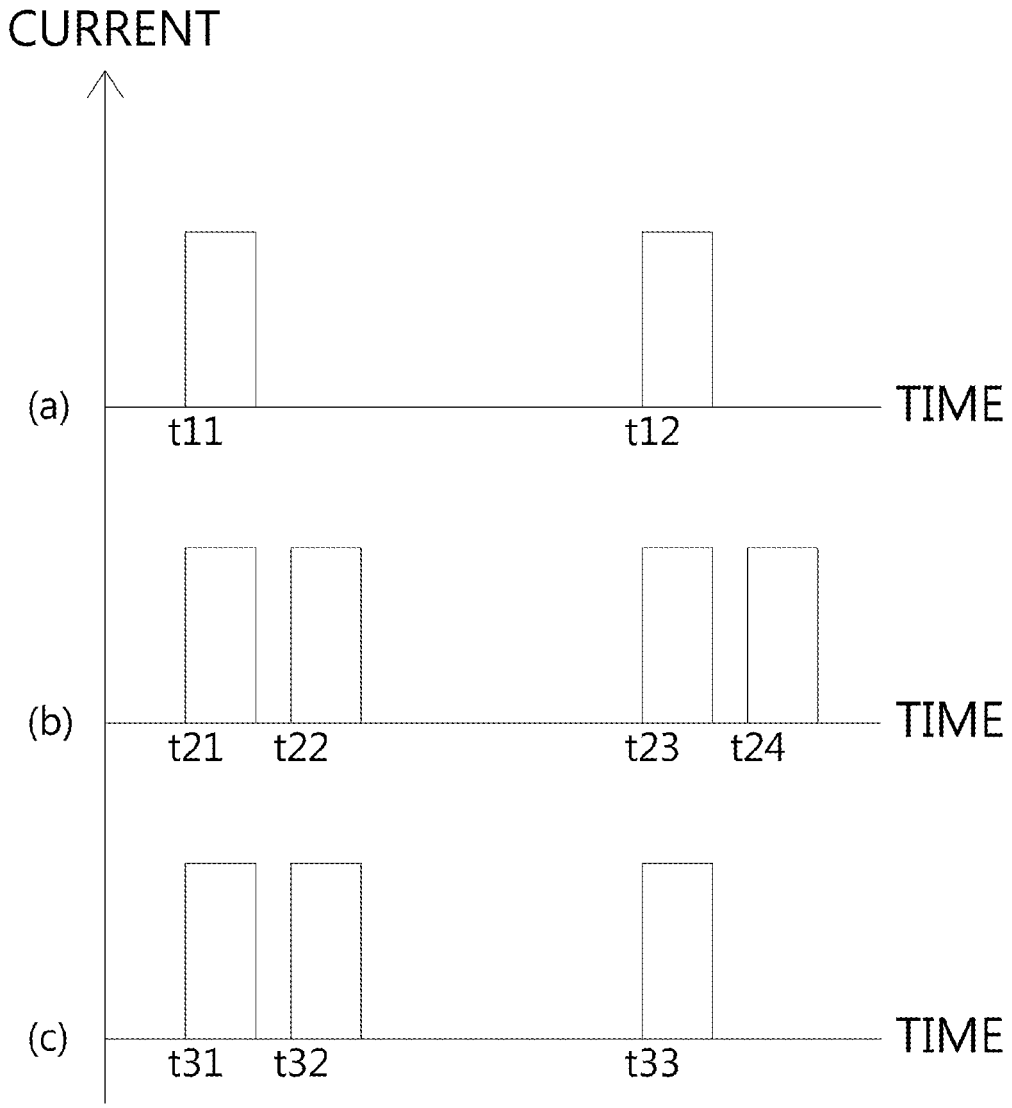
FIG. 4 is a control diagram showing movement time of first and second movable electrodes of the vacuum interrupter according to the embodiment of the present invention.

FIG. 4 is a control diagram showing moving times of first and second movable electrodes of the vacuum interrupter according to the embodiment of the present invention.

Referring to FIG. 4, in the vacuum interrupter 100 according to the present invention, as described above, moving times and moving speeds of the first and second movable electrodes 120 and 130 may be controlled according to times of applying current to the first and second driving units 170*a* and 170*b* by the controller 180. In FIG. 4, for convenience of explanation, an example of contacting the first and second movable contacts 140 and 150 will be described. First, as shown in FIG. 4(*a*), the first and second movable electrodes 120 and 130 may move at the same time. For this, at time t11, current is simultaneously applied to both contact coils 171. Then, at time t12, current is simultaneously applied to both separation coils 172 just before the first and second movable contacts 140 and 150 contact each other so that impact therebetween is reduced.

In FIG. 4(*b*), the first and second movable electrodes 120 and 130 may move with a predetermined fixed time interval (Δt1). For this, current is applied to the contact coil 171 of the first driving unit 170*a* at time t21, and after passing a fixed time interval, current is applied to the contact coil 171 of the second driving unit 170*b* at time t22. Then, just before the first and second movable contacts 140 and 150 contact each other, current is applied to the separation coil 172 of the first driving unit 170*a* and the separation coil 172 of the second driving unit 170*b* at times t23 and t24, respectively, so that impact therebetween is reduced.

In FIG. 4(*c*), current is applied to the contact coil 171 of the first driving unit 170*a* at time t31, and after passing a fixed time interval, current is applied to the contact coil 171 of the second driving unit 170*b* at time t32. Then, just before the first and second movable contacts 140 and 150 contact each other, current is only applied to the separation coil 172 of the second driving unit 170*b* at time t33. The above process is performed so that the second movable contact 150 arrives later than the first movable contact 140, and a moving speed of the second movable contact 150 decreases.

As described above, in the present invention, moving times and moving speeds of movable electrodes may be adjusted. The figure shown in FIG. 4 is merely an example for explaining the present invention, and the moving times and moving speeds of the movable electrodes can be controlled by various methods.

As described above, in the vacuum interrupter according to the present invention, speed of forming and releasing a short circuit is increased by providing two movable electrodes which are capable of moving in forward/backward directions. In addition, moving speeds of the movable electrodes are adjusted just before the movable electrodes contact each other while the movable electrodes move in forward/backward directions, so that impact occurring due to contact between the electrodes may be reduced. Compared to the prior art, the present invention has a remarkably desirable effect from a viewpoint of moving speed and impact reduction.

Even if it was described above that all of the components of an embodiment of the present invention are coupled as a single unit or coupled to be operated as a single unit, the present invention is not necessarily limited to such an embodiment. That is, at least two elements of all structural elements may be selectively joined and operate without departing from the scope of the present invention. In addition, since terms, such as "including", "comprising", and "having" mean that one or more corresponding components may exist unless they are specifically described to the contrary, it shall be construed that one or more other components can be included. All the terms that are technical, scientific or otherwise agree with the meanings as understood by a person skilled in the art unless defined to the contrary. Common terms as found in dictionaries should be interpreted in the context of the related technical writings not too ideally or impractically unless the present disclosure expressly defines them so.

Although the embodiments of the present invention have been described for illustrative purposes, those skilled in the art will appreciate that various modifications, additions and substitutions are possible, without departing from the scope and spirit of the invention. Accordingly, the embodiments disclosed in the present invention are merely to not limit but describe the technical spirit of the present invention. Further, the scope of the technical spirit of the present invention is limited by the embodiments. The scope of the present invention shall be construed on the basis of the accompanying claims in such a manner that all of the technical ideas included within the scope equivalent to the claims belong to the present invention.

The invention claimed is:

1. A vacuum interrupter, comprising:

a housing with a vacuum state therein;

a first and a second movable electrodes partially accommodated within the housing and having a first and a second movable contacts disposed at a respective first end thereof, the first and second movable electrodes being capable of moving in forward/backward directions so that the first and second movable contacts contact each other or are separate from each other by movements in the forward/backward directions of the first and second electrodes;

a first and a second driving parts respectively connected to a second end of each of the first and second movable electrodes and moving the first and second movable electrodes in the forward/backward directions; and a controller controlling movements of the first and second driving parts, wherein the controller adjusts moving times and moving speeds of the first and second movable electrodes by adjusting times of applying current to the first and the second driving parts.

2. The vacuum interrupter of claim 1, wherein the controller controls the first and second driving parts to move the first and second movable electrodes so that the first and second movable contacts contact each other, and the first and second movable electrodes simultaneously moves, or moves with a predetermined time interval.

3. The vacuum interrupter of claim 1, wherein each of the first and second driving parts includes:

a contact coil generating magnetic force by using current applied from the controller and moving each of the first and second movable electrodes so that the first and second movable contacts contact each other; and a separation coil generating magnetic force by using current applied from the controller and moving each of the first and second movable electrodes so that the first and second movable contacts are separated from each other.

4. The vacuum interrupter of claim 3, wherein the controller applies current to the contact coils such that the first and second movable contacts contact each other, and applies current to the separation coils just before the first and second movable contacts contact each other such that moving speeds of the first and second movable contacts decrease.

5. The vacuum interrupter of claim 4, wherein the controller simultaneously applies current to the contact coils of the first and second driving parts, and simultaneously applies current to the separation coils of the first and second driving parts when a predetermined time has passed after applying current to the contact coils of the first and second driving units.

6. The vacuum interrupter of claim 4, wherein the controller simultaneously applies current to the contact coils of the first and second driving parts, and applies current to any one of the separation coils of the first and second driving units when a predetermined time has passed after applying current to the contact coils of the first and second driving parts.

7. A method of driving a vacuum interrupter, the method comprising:

respectively operating, by a controller, a first driving part and a second driving part, respectively connected to a first and a second movable electrodes, to move the first and second movable electrodes in forward/backward directions;

respectively moving the first and second movable electrodes within a vacuum interrupter by the first and second driving parts; and contacting a first and a second movable contacts each other according to movements of the first and second movable electrodes, the first and second movable contacts being respectively attached to first ends of the first and second movable electrodes, wherein the controller adjusts moving times and moving speeds of the first and second movable electrodes by adjusting times of applying current to the first and the second driving parts.

8. The method of claim 7, wherein the first and second movable electrodes simultaneously move, or move with a predetermined time interval.

9. The method of claim 7, wherein in the moving of the first and second movable electrodes, a moving speed of at least one of the first and second movable electrodes decreases to a predetermined level just before the first and second movable contacts contact each other.

10. The method of claim 7, further comprising: after contacting the first and second movable contacts each other, moving the first and second movable electrodes away from each other so that the first and second movable contacts are separated from each other.

11. A method of driving a vacuum interrupter, the method comprising:

respectively applying current to contact coils of a first and a second driving parts to respectively move a first and a second movable electrodes within a vacuum interrupter by a controller;

respectively moving the first and second movable electrodes by using magnetic force of the contact coils generated by the applied current so that a first and a second movable contacts respectively attached to first ends of the first and second movable electrodes contact each other; and respectively applying current to separation coils of the first and second driving parts just before the first and second movable contacts contact each other so that moving speeds of the first and second movable electrodes decreases, wherein the controller adjusts moving times and moving speeds of the first and second movable electrodes by adjusting times of applying current to the first and the second driving part.

12. The method of claim 11, further comprising: after the first and second movable contacts contact each other, respectively applying current to the separation coils of the first and second driving parts so that the first and second movable contacts are separated from each other; and moving the first and second movable electrodes away from each other by using magnetic force of the separation coils generated by the applied current so that the first and second movable contacts move away from each other.

* * * * *